US011234517B2

(12) United States Patent
Rehage

(10) Patent No.: US 11,234,517 B2
(45) Date of Patent: Feb. 1, 2022

(54) DEVICE FOR STORING OBJECTS, AND METHOD FOR OPENING AND CLOSING SUCH A DEVICE

(71) Applicant: Paul Hettich GmbH & Co. KG, Kirchlengern (DE)

(72) Inventor: Daniel Rehage, Chemnitz (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

(21) Appl. No.: 16/756,913

(22) PCT Filed: Oct. 5, 2018

(86) PCT No.: PCT/EP2018/077147

§ 371 (c)(1),
(2) Date: Apr. 17, 2020

(87) PCT Pub. No.: WO2019/076649

PCT Pub. Date: Apr. 25, 2019

(65) Prior Publication Data

US 2021/0196044 A1 Jul. 1, 2021

(30) Foreign Application Priority Data

Oct. 18, 2017 (DE) ..... 10 2017 124 269.4

(51) Int. Cl.
*A47B 88/75* (2017.01)
*A47B 88/447* (2017.01)
(Continued)

(52) U.S. Cl.
CPC ..... *A47B 88/75* (2017.01); *A47B 88/447* (2017.01); *A47B 88/45* (2017.01); *F25D 25/025* (2013.01);
(Continued)

(58) Field of Classification Search
CPC ..... A47B 88/44; A47B 88/447; A47B 88/45; A47B 88/70; A47B 88/02; A47B 88/75;
(Continued)

(56) References Cited

U.S. PATENT DOCUMENTS 2,843,441 A * 7/1958 Jewell ..... F25D 25/025 312/301
5,439,284 A * 8/1995 Grabher ..... A47B 88/427 312/334.6
(Continued)

FOREIGN PATENT DOCUMENTS

DE 3737994 A1 5/1989
DE 102011050523 A1 * 11/2012 ..... A47B 88/70
(Continued)

OTHER PUBLICATIONS

International Search Report for PCT/EP2018/077147 dated Nov. 23, 2018.
(Continued)

*Primary Examiner* — Andrew M Roersma
(74) *Attorney, Agent, or Firm* — Collard & Roe, P.C.

(57) ABSTRACT

A device for storing objects has a first drawer element which is movably mounted via at least one first pullout guide between a closed position and a maximally open position. The pullout guide has a stationary guide rail and a slide rail movable in relation to the guide rail, on which the first drawer element is supported, and a second drawer element, which is movably mounted via at least one pullout guide between a closed position and a maximally open position. The pullout guide comprises a stationary guide rail and a slide rail movable in relation to the guide rail, on which the second drawer element is supported. A method for opening and closing the device for storing objects includes opening and closing the drawer elements.

14 Claims, 15 Drawing Sheets

(51) Int. Cl.
*F25D 25/02* (2006.01)
*A47B 88/45* (2017.01)

(52) U.S. Cl.
CPC ... *A47B 2088/76* (2017.01); *A47B 2210/0072* (2013.01); *A47B 2210/175* (2013.01)

(58) Field of Classification Search
CPC ..... A47B 2088/023; A47B 2088/026; A47B 2088/76; A47B 2210/0064; A47B 2210/0067; A47B 2210/007; A47B 2210/0072; A47B 2210/17; A47B 2210/175; F25D 25/025
See application file for complete search history.

(56) References Cited

U.S. PATENT DOCUMENTS

| | | | | |
|---|---|---|---|---|
| 8,708,436 | B2 * | 4/2014 | Laible | A47B 88/95 312/334.7 |
| 10,058,176 | B2 | 8/2018 | Rehage | |
| 2006/0218958 | A1 | 10/2006 | Rand et al. | |
| 2010/0101266 | A1 | 4/2010 | Kang et al. | |
| 2016/0209107 | A1 * | 7/2016 | Choi | F25D 25/025 |
| 2017/0227280 | A1 * | 8/2017 | Yang | A47B 88/41 |
| 2018/0100690 | A1 * | 4/2018 | Gatter | F25D 23/02 |

FOREIGN PATENT DOCUMENTS

| | | | | | |
|---|---|---|---|---|---|
| DE | 1020111050523 | A1 | | 11/2012 | |
| DE | 202013104534 | U1 | | 1/2015 | |
| DE | 102014104919 | A1 | | 10/2015 | |
| DE | 102014107692 | A1 | | 12/2015 | |
| JP | H-05113289 | A | * | 5/1993 | F25D 25/025 |
| JP | 2001349665 | A | * | 12/2001 | F25D 25/025 |
| KR | 20110010406 | A | | 2/2011 | |
| KR | 20140074520 | A | * | 6/2014 | F25D 25/025 |
| WO | WO-2015185557 | A1 | * | 12/2015 | A47B 88/423 |

OTHER PUBLICATIONS

German Search Report dated Oct. 1, 2018, issued in the corresponding German Application 10 2017 124 269.4 (with English translation of relevant parts).

* cited by examiner

DEVICE FOR STORING OBJECTS, AND METHOD FOR OPENING AND CLOSING SUCH A DEVICE

CROSS REFERENCE TO RELATED APPLICATIONS

This application is the National Stage of PCT/EP2018/077147 filed on Oct. 5, 2018, which claims priority under 35 U.S.C. § 119 of German Application No. 10 2017 124 269.4 filed on Oct. 18, 2017, the disclosures of which are incorporated by reference. The international application under PCT article 21(2) was not published in English.

BACKGROUND OF THE INVENTION

The present invention relates to a device for storing objects, having a first drawer element which is movably mounted via at least one first pullout guide between a closed position and a maximally open position, which pullout guide comprises a stationary guide rail and a slide rail movable in relation to the guide rail, on which the first drawer element is supported, and a second drawer element, which is movably mounted via at least one pullout guide between a closed position and a maximally open position, which pullout guide comprises a stationary guide rail and a slide rail movable in relation to the guide rail, on which the second drawer element is supported, and a method for opening and closing a device for storing objects.

DE 10 2014 104 919 A1 discloses an item of furniture or a domestic appliance, in which a first and a second pullout guide, which each movably hold a drawer element, are provided on a body having two side walls. The two pullout guides are aligned at an angle with respect to the movement direction and are positively coupled to one another, so that in the event of a movement of the first drawer element, the second drawer element is movable at least in regions. The angled alignment of the pullout guides in relation to one another enables the compensation of a height offset of the drawer elements, however, the actuating forces upon raising of one of the drawer elements are high, and moreover this arrangement is only reasonable if the front drawer element in the pullout direction is pulled comparatively far out of the body. The connection in series of multiple pullout guides also increases the possible lateral movements due to tolerances in this case.

DE 10 2011 050 523 A1 discloses a pullout system for an item of furniture or a domestic appliance, in which two drawer elements are provided, which are coupled to one another via a gearing, in order to move the second drawer element in the event of a movement of the first drawer element. In this case, the drawer elements can be moved at different speeds. It is also disadvantageous in this solution that an access to the lower drawer element is only possible if the upper drawer element is moved out of the body over a comparatively large distance. The tolerances due to the mounting of a plurality of rails of the pullout guides in succession thus add up. Sufficient space is not available in all kitchens or living rooms to be able to implement such large pullout distances. If the upper drawer element is only moved over a shorter distance out of the body, the access to the lower drawer element is partially concealed.

Moreover, a drawer arrangement is known from DE 10 2014 107 692 A1, in which a first drawer element is held on two slide rails of two pullout guides and a second drawer element is held on two middle rails of the two pullout guides. The possibility thus results of also moving the second drawer element, which can be arranged above the first drawer element, via a movement of the first drawer element, wherein the access to the drawer elements is partially covered.

SUMMARY OF THE INVENTION

It is therefore the object of the present invention to provide a device for storing objects which enables improved handling and good access to two drawer elements. Moreover, in a method for opening and closing such a device, the handling is to be improved for the user.

This object is achieved by a device having the features of Claim 1 and a method having the features of Claim 14.

The device according to the invention comprises two drawer elements, which are used for storing objects and are each movable via at least one first or at least one second pullout guide. In this case, a coupling mechanism is provided, by means of which, in the event of a movement of the first drawer element from the closed position into the maximally open position, the second drawer element is movable into a moderately open position, which is between the closed position and the maximally open position, for example, a distance from the closed position between 30% to 70% of the distance up to the maximally open position. The coupling mechanism is detachable in this case to be able to move the second drawer element if needed independently of the first drawer element into the maximally open position or the closed position. The "detachability" of the coupling mechanism is produced in this case without installation activity, but rather preferably only by moving the second drawer element in the opening or closing direction, possibly assisted by additional raising of the drawer element. After such a decoupling of the coupling mechanism, the second drawer element can be moved independently of the first drawer element. The second drawer element is preferably arranged above the first drawer element, and by moving the second drawer element from an open position into the closed position, a better access is provided to the first drawer element located underneath. In the open position produced by the coupling mechanism, both the first and also the second drawer element are located in a position partially accessible from above.

The coupling mechanism preferably comprises a catch unit having a catch receptacle and a catch element engaging in the catch receptacle. This catch unit can transmit sufficient forces to also move the second drawer element by pulling on the first drawer element. If a specific force is exceeded and/or by raising the second drawer element, the catch unit can be detached, so that the coupling mechanism between the first and second drawer element is then also disconnected.

In a further design, the first pullout guide comprises a middle rail, which is arranged between the slide rail and the guide rail, wherein the second drawer element is movable at the same speed as the middle rail via the coupling mechanism. The second drawer element can optionally be connected in this case directly to the middle rail via the coupling mechanism or to the slide rail, if the coupling mechanism comprises a unit for reducing the speed, so that the second drawer element moves slower than the slide rail of the first pullout guide.

A driver, which can be detachably engaged with a coupling element, is preferably provided on the second drawer element. The driver can comprise, for example, a catch receptacle, which comprises a starting bevel for coupling in a driver on opposing sides. The coupling mechanism can thus be brought automatically into the coupled-in position, for example, by the first drawer element being moved into the closed position, whereby the coupling element or catch element is moved along the starting bevel to then arrive in the catch receptacle. A catch receptacle open in the installed position moreover results in the advantage that the locking and holding forces of the catch unit are dependent on the weight load of the second drawer element, so that upon loading of the second drawer element, higher holding and locking forces are transmitted by the catch unit than in the case of an empty second drawer element.

In a further design, the coupling mechanism comprises a movable rail, which is connected via a cable pull to a holding part and the slide rail of the first pullout guide. The rail is thus moved via the fixation on the stationary holding part and the slide rail of the first pullout guide at half the speed of the slide rail of the first pullout guide and thus can move the second drawer element at the desired speed over the required distance. The use of a rail on the coupling mechanism has the advantage that it can be arranged inside a body and is only moved slightly out of the body in the maximally open position. The coupling mechanism can comprise at least one deflection roller for a cable pull in this case, wherein the deflection roller has an axis which protrudes beyond the deflection roller, so that the axis is usable as a catch element and is insertable into a catch receptacle on the driver on the second drawer element.

For simple handling, the second drawer element can be able to be raised relative to the second pullout guide to detach the coupling mechanism. A stop is preferably provided, which delimits the movement of the second drawer element upward, in order to avoid complete removal of the drawer element from the slide rail of the at least one second pullout guide.

In one preferred design, the second drawer element is designed as an inner drawer, which is arranged behind a front panel of the first drawer element. In this case, the first drawer element can be movable on two pullout guides arranged on opposing sides, and the second drawer element is movably mounted on two second pullout guides, which can also be fixed on opposing side walls or on a common holder.

The device according to the invention is preferably used in domestic appliances, such as refrigerators, or items of furniture.

In the method according to the invention for opening and closing a device, firstly a first drawer element, which is movably mounted on at least one first pullout guide, is moved from a closed position into a maximally open position. A second drawer element, which is movably mounted on at least one second pullout guide, is moved by a coupling mechanism between the first drawer element and the second drawer element by moving the first drawer element into a moderately open position, wherein the coupling mechanism can then be decoupled to optionally move the second drawer element independently of the first drawer element in the opening or closing direction. The coupling mechanism can be coupled in again by moving the first drawer element into the closed position. The second drawer element is preferably moved at half the speed of the first drawer element during a movement of the first drawer element. The user can thus optionally move the second drawer element into the maximally open position, in order to have an optimum access to the second drawer element, or the drawer element is moved back into the closed position, in order to have an optimum access to the lower first drawer element.

BRIEF DESCRIPTION OF THE DRAWING FIGURES

DETAILED DESCRIPTION OF THE INVENTION

A device 1 for storing objects comprises a first drawer element 2, which is arranged below a second drawer element 4 in a closed position. The second drawer element 4 is designed in this case as an inner drawer, which is arranged behind a front panel 3 of the first drawer element 2. By pulling on a handle element on a front panel 3, both the first drawer element 2 and also the second drawer element 4 can be moved in the opening direction. The device 1 can optionally be arranged in a domestic appliance or an item of furniture in this case, wherein each drawer element 2 and 4 is preferably movably held via two pullout guides, which are arranged on opposing sides.

Figure 2:
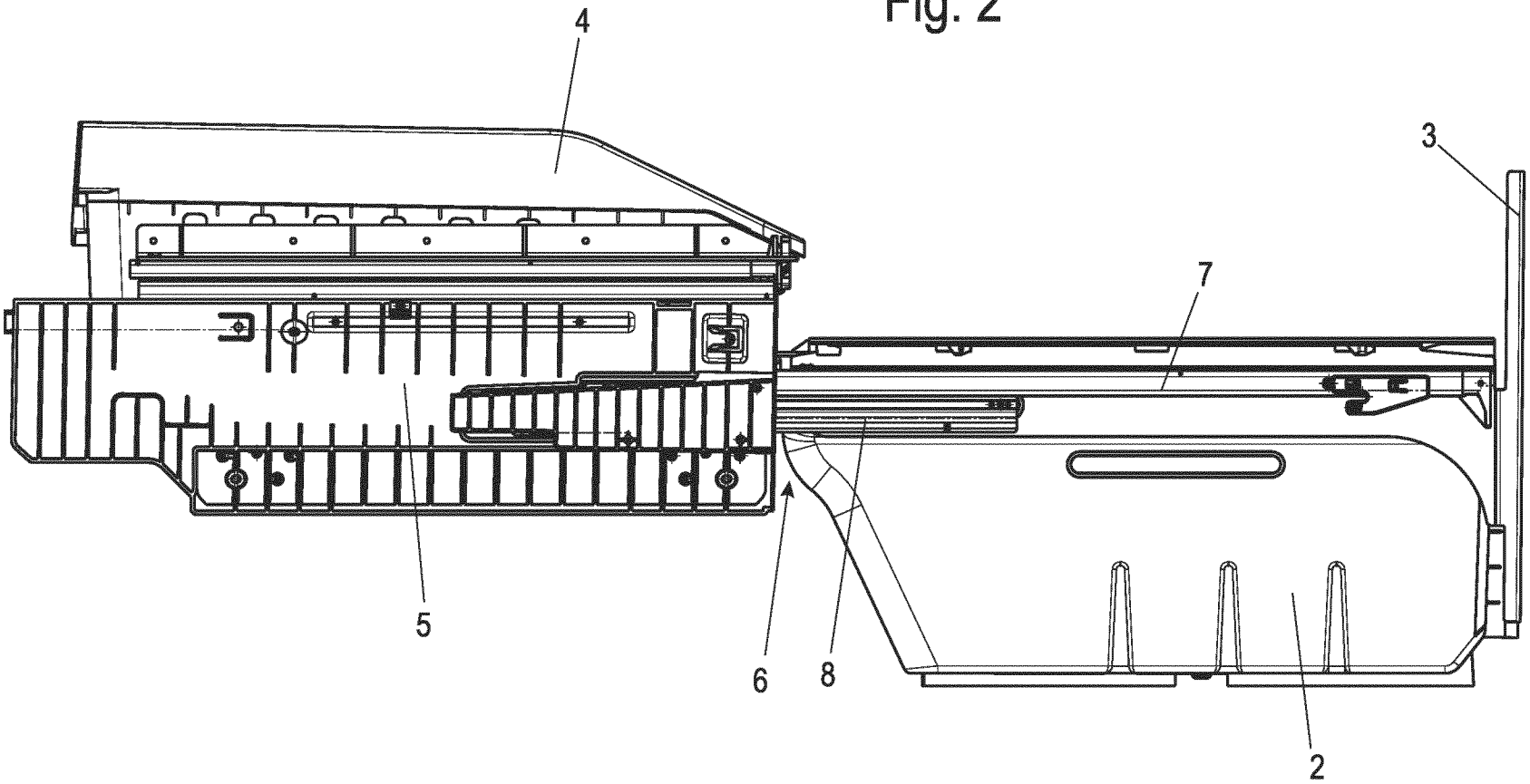
FIG. 2 shows a view of the device of FIG. 1 having the first drawer element in the maximally open position.

In FIG. 2, the first drawer element 2 has been moved into a maximally open position. The first drawer element 2 is movably held on at least one pullout guide 6, which comprises a stationary guide rail 9 fixed on a holder 5, a middle rail 8, and a slide rail 7, which are each movably mounted on one another via roller bodies. The slide rail 7 is used to support the first drawer element 2. It is also possible to use a pullout guide 6 having only two rails or more than three rails.

Figure 3:
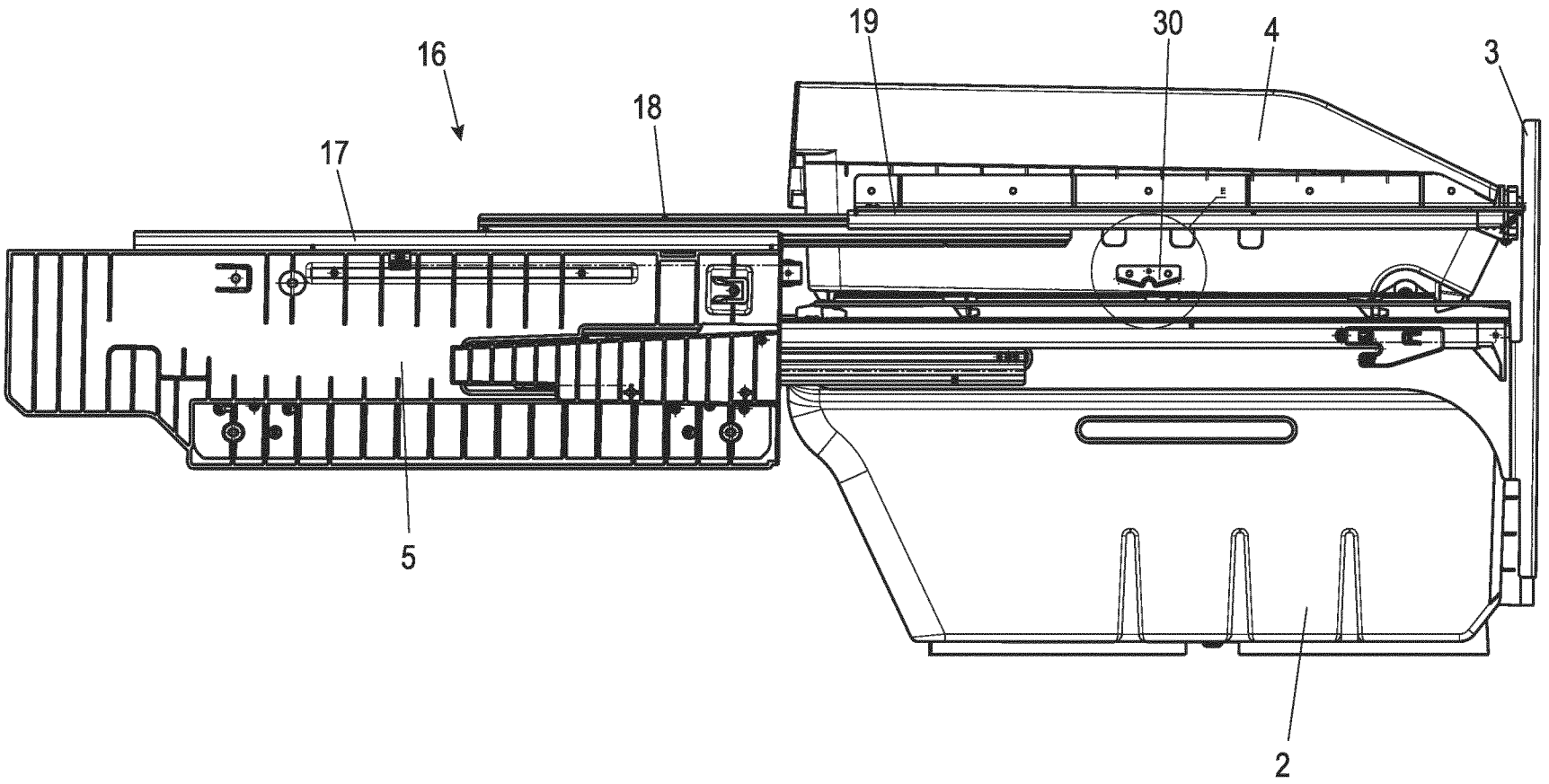
FIG. 3 shows a view of the device of FIG. 1 having the first drawer element and the second drawer element in the maximally open position.

As shown in FIG. 3, the second drawer element 4 can also be moved from a closed position into a maximally open position, wherein the second drawer element 4 is held on at least one, preferably two pullout guides 16, wherein each of these pullout guides 16 comprises a stationary guide rail 17, a middle rail 18, and a slide rail 19 for supporting the second drawer element 4. The guide rail 17 is fixed on the stationary plate-shaped holder 5, which can be secured on a side wall of a body or can also be formed as a side wall of a body.

Figure 1:
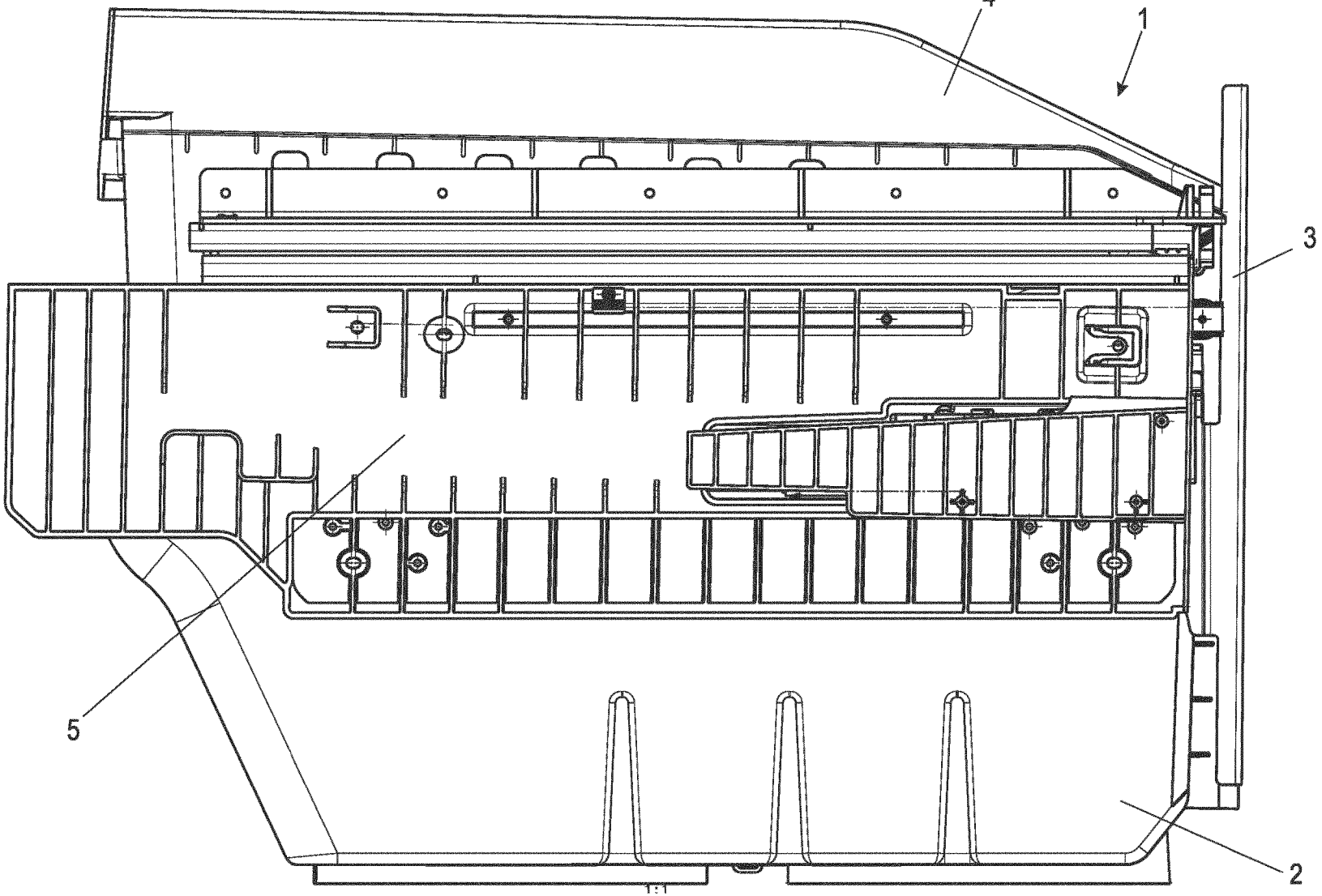
FIG. 1 shows a view of a device according to the invention in the closed position.

The drawer elements 2 and 4 and also the slide rails 7 and 19 of the pullout guides 6 and 16 are movable independently of one another, as shown in FIGS. 1 to 3.

Figure 4:
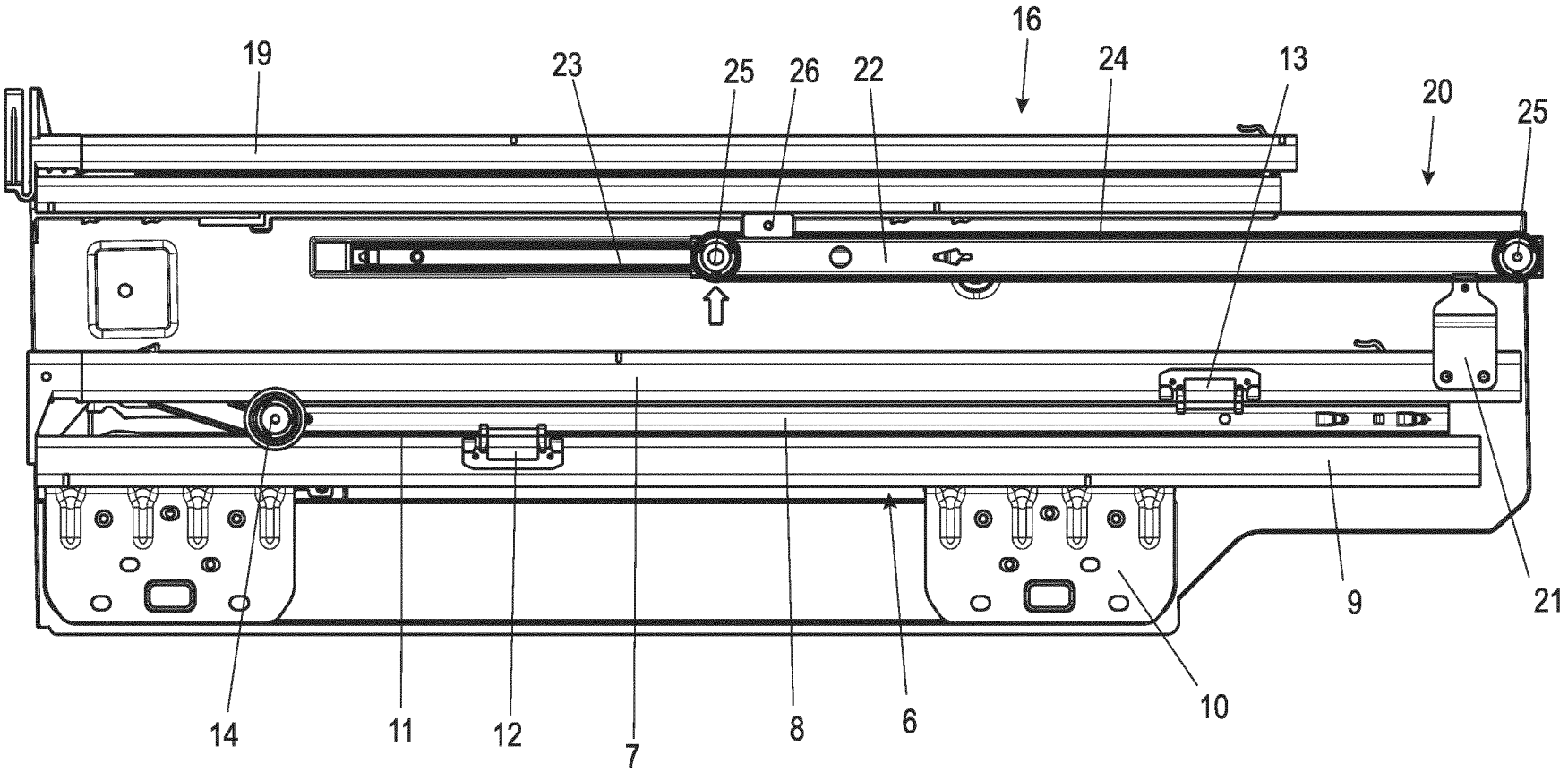
FIG. 4 shows a view of the device of FIG. 1 without drawer elements.

In FIG. 4, the device of FIGS. 1 to 3 is shown without the drawer elements 2 and 4, but looking toward the pullout guides 6 and 16, which are fixed via mounting brackets 10 on a side wall of the body 50.

A cable pull 11, which is connected to a first holder 12 on the stationary guide rail 9 and to a second holder 13 on the slide rail 7, is provided on the first pullout guide 6. The cable pull 11 is held circulating via deflection rollers 14 and 15, which are rotatably mounted on the middle rail 8. It is thus ensured that the slide rail 7 is moved at twice the speed of the middle rail 8.

A coupling mechanism 20 is provided between the first drawer element 2 and the second drawer element 4, which can move the second drawer element 4 during a movement of the first drawer element 2, but at lower speed than the first drawer element 2, in particular at half speed. The coupling mechanism 20 comprises a holding part 21, which is secured on the slide rail 7 of the first pullout guide 6. The holding part 21 is fixed on a cable pull 24, which is tensioned circulating between two deflection rollers 25. The deflection rollers 25 are rotatably mounted in this case on a movable rail 22, which is linearly movable in relation to a stationary rail 23. The cable pull 24 is fixed on a fastening element 26, which is directly or indirectly connected to the holder 5 or a side wall and is arranged in a stationary manner. During a movement of the slide rail 7 in the opening direction, the cable pull 24 is held by the fastening element 26 and driven by the holding part 21, so that the rail 22 moves at approximately half the speed of the slide rail 7.

Figure 5:
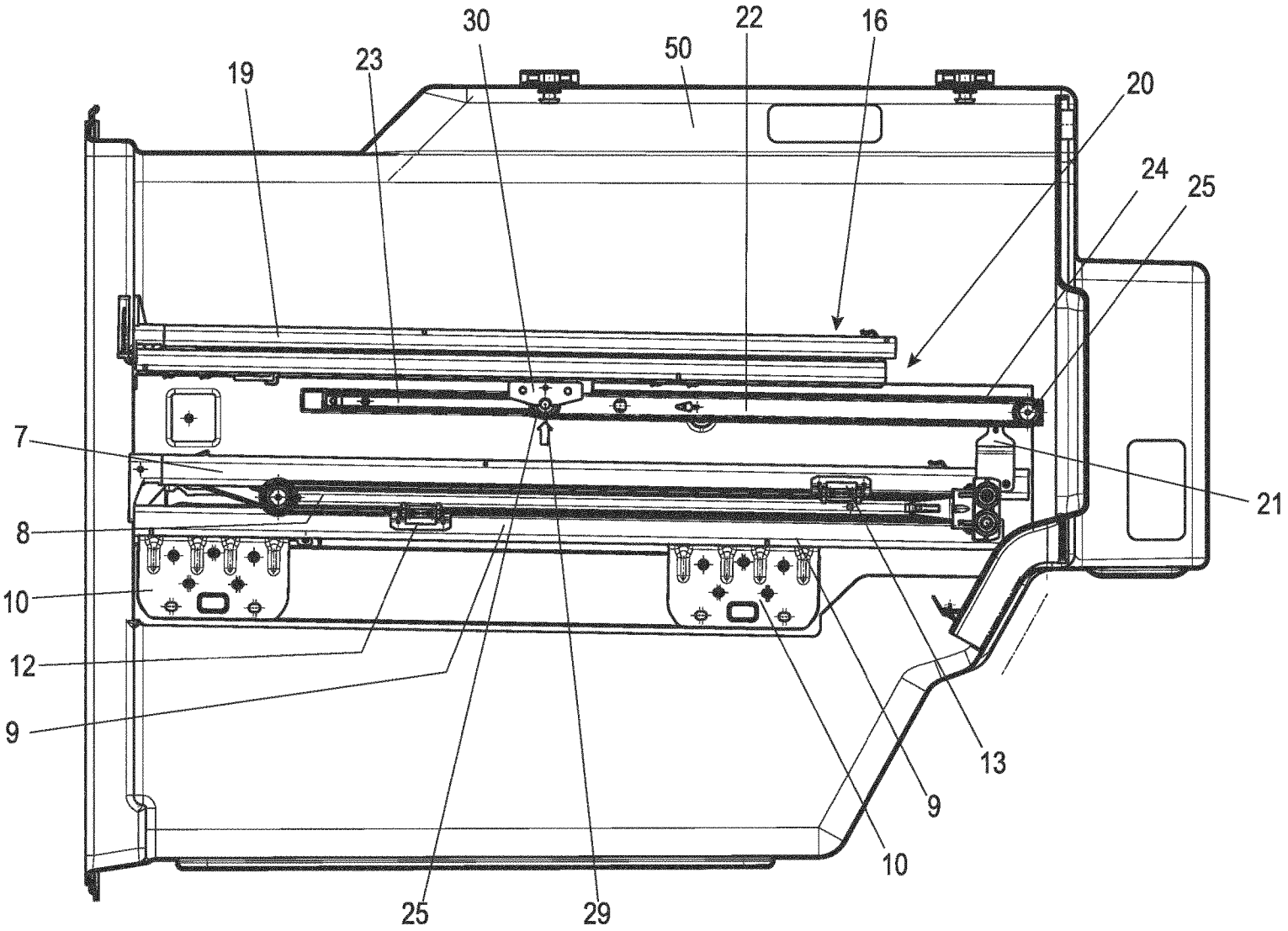
FIG. 5 shows a view similar to FIG. 4 having a body.

In FIG. 5, the device 1 is shown having the pullout guides 6 and 16 in the closed position. Both pullout guides 6 and 16 and the drawer elements 2 and 4 supported thereon in the installed situation are located inside a body 50, for example, an insulated hollow chamber of a refrigerator. A driver 30, which can be coupled to an axis 29, which protrudes laterally on the deflection roller 25, is provided on the upper second drawer element 4. If the slide rail 7 is moved out of the position shown in FIGS. 4 and 5 via the first drawer element 2 in the opening direction, the movable rail 22 is driven at half the speed of the slide rail 7 via the coupling mechanism 20 via the cable pull 24, whereby the axis 29 also drives the driver 30 at half speed. The second drawer element 4 is thus moved at half the speed of the first drawer element 2 in the opening direction and thus also over half the distance of the first drawer element 2.

Figure 6:
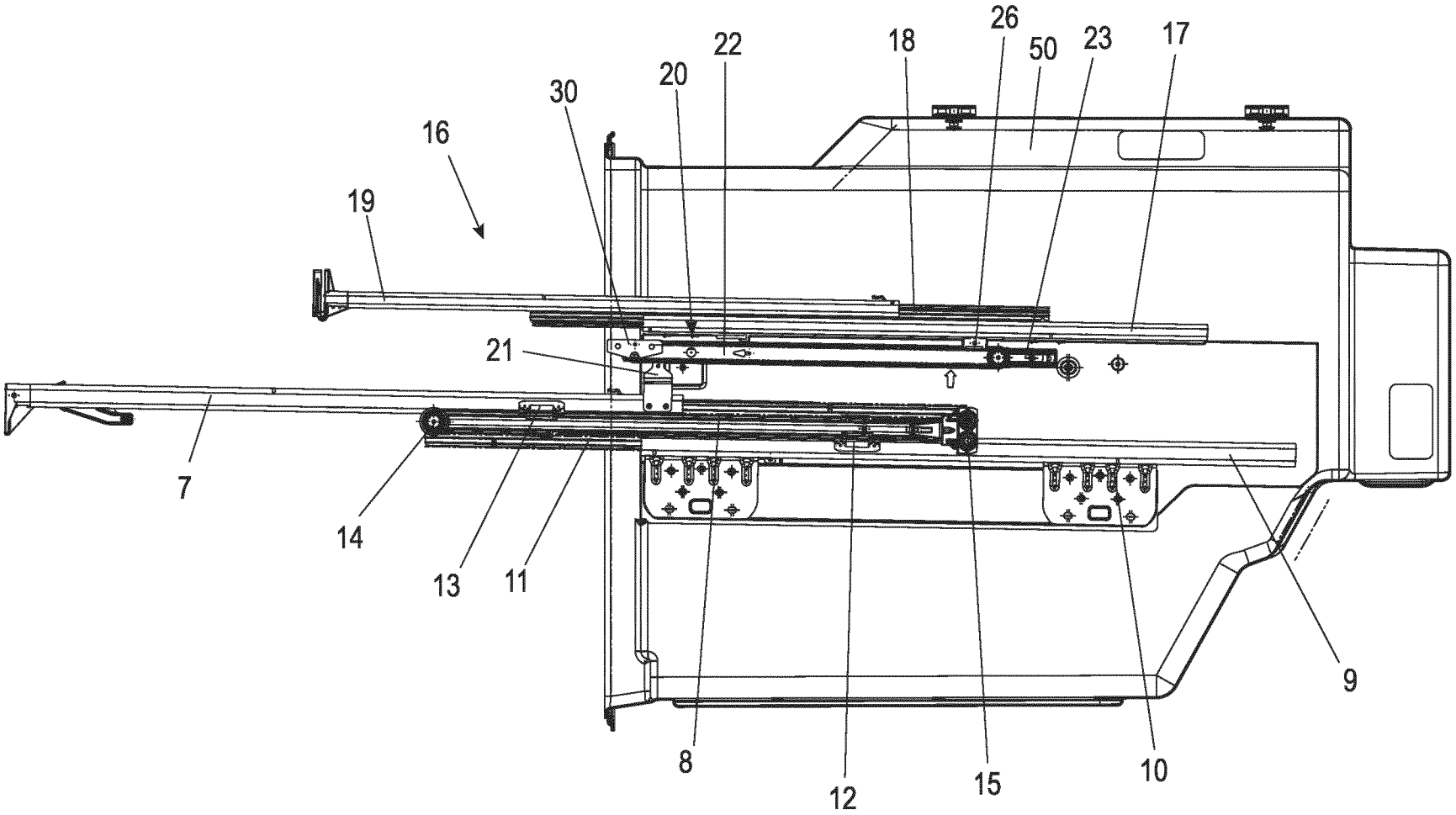
FIG. 6 shows a view of the device of FIG. 4 having the first pullout guide in the maximally open position.

In FIG. 6, the slide rail 7 of the first pullout guide 6 is arranged in the maximally open position. The holding part 21 has driven the cable pull 24, and the movable rail 22 has been moved in relation to the stationary rail 23 into the end position, in which the movable rail 22 protrudes only slightly out of the body 50. The driver 30 is arranged in a coupled-in position, and the second pullout guide 16, and therefore also the upper second drawer element 4 (not shown here), is located approximately in the half-open position between the closed position and the maximally open position.

If the user now wishes to obtain an access to the upper second drawer element 4, he can detach the coupling mechanism 20 and move the second drawer element 4 via the pullout guide 16 in the opening direction. The position shown in FIG. 3 is then reached, in which the second drawer element 4 is arranged essentially in front of the body 50 and the holder 5. The first drawer element 2 is then covered on the upper side by the second drawer element 4.

In contrast, if the user wishes to obtain an improved access to the lower first drawer element 2, the coupling mechanism 20 can be disconnected, and the second drawer element 4 can be moved into the closed position in order to have a complete access to the first drawer element 2 from above, as shown in FIG. 2.

The user can optionally also leave the coupling mechanism 20 engaged and thus also simultaneously move the second drawer element 4 by moving the first drawer element 2.

The at least one first pullout guide 6 and/or the at least one second pullout guide 16 can be provided with a self-retractor, which decelerates the drawer elements 2 and 4 via a damper before reaching the closed position and then pulls them into the closed position.

Figure 7:
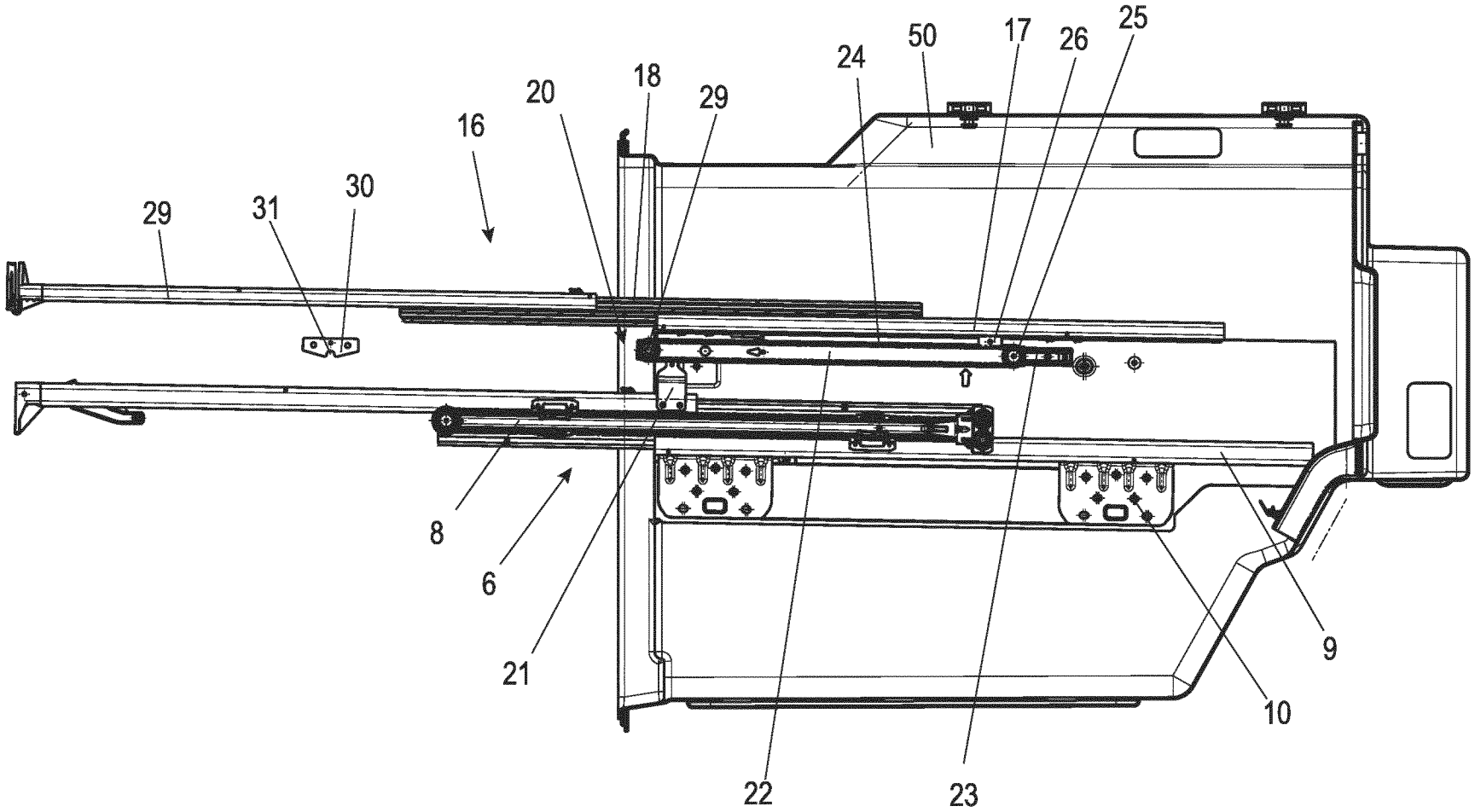
FIG. 7 shows a view of the device of FIG. 6, in which the second pullout guide is also moved into the maximally open position.

In FIG. 7, the coupling mechanism 20 is disconnected, and the second pullout guide 16 has been moved into the maximally pulled-out position. The driver 30, which is secured or integrally formed on the drawer element 4, has been removed from the axis 29 of the deflection roller 25, so that both pullout guides 6 and 16 are movable independently of one another.

Figure 8:
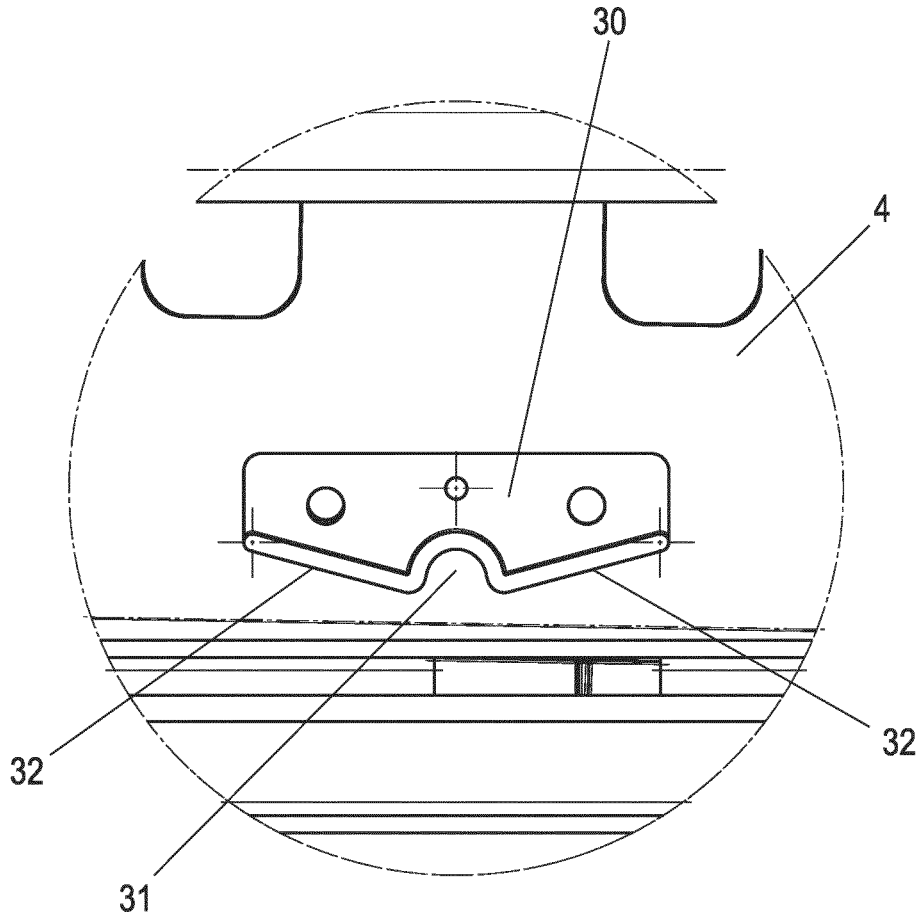
FIG. 8 shows a detail view of the driver of the coupling mechanism.

A detail view of the driver 30 is shown in FIG. 8, which is installed on the drawer element 4 on a side wall, but can also be provided at another position or can be integrally formed with the drawer element 4. The driver 30 comprises a catch receptacle 31, which is open toward the bottom and is formed essentially semicircular, wherein a starting bevel 32 is provided on both sides of the catch receptacle 31.

Figure 9:
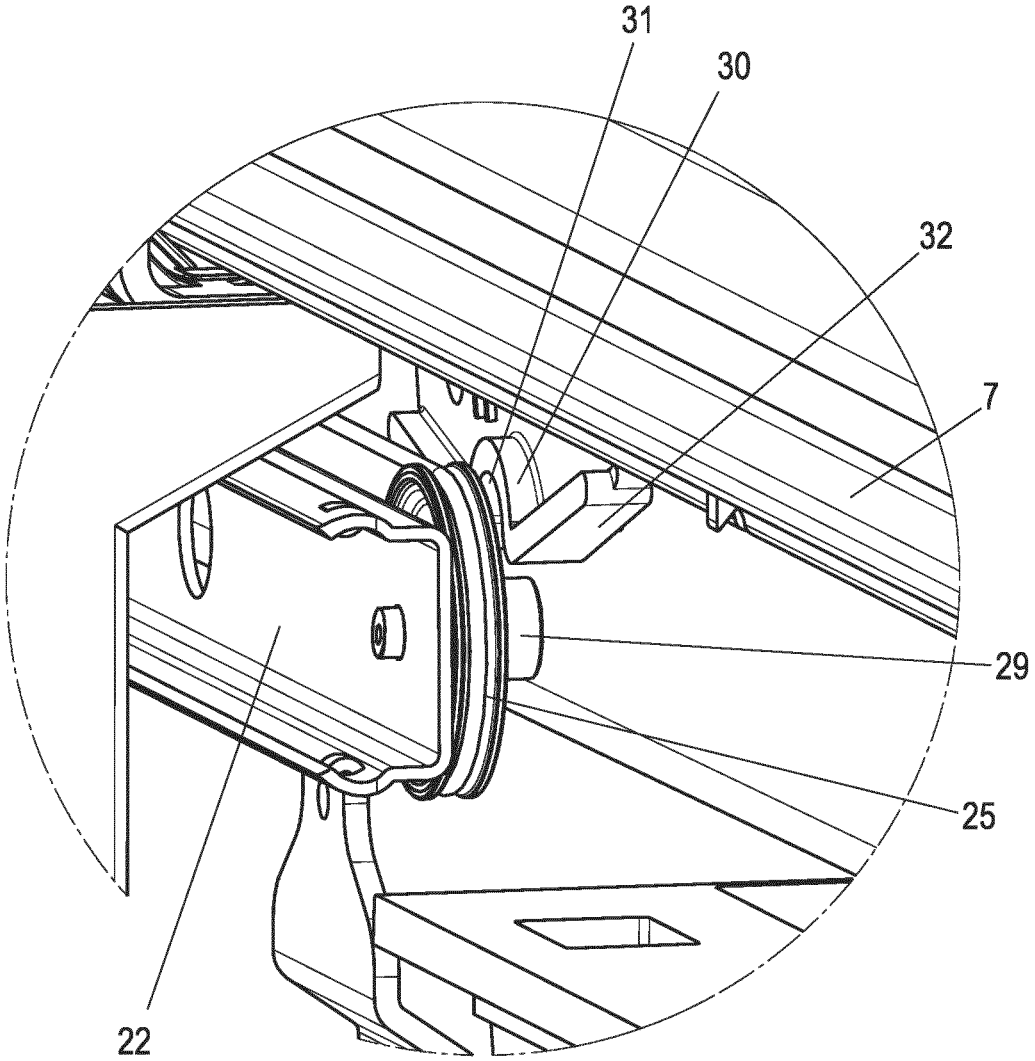
FIG. 9 shows a perspective detail view of the driver in the decoupled position.

In FIG. 9, the catch unit of the coupling mechanism 20 is shown. The deflection roller 25, which is rotatably mounted on an axis 29, is located on the movable rail 22, wherein the axis 29 protrudes laterally beyond the deflection roller 25 and can be engaged with the catch receptacle 31. The axis 29 can be moved along one of the two starting bevels 32 for a coupling of the catch unit in this case, so that the second drawer element 4 is slightly raised before the axis 29 locks in the catch receptacle 31.

Figure 10:
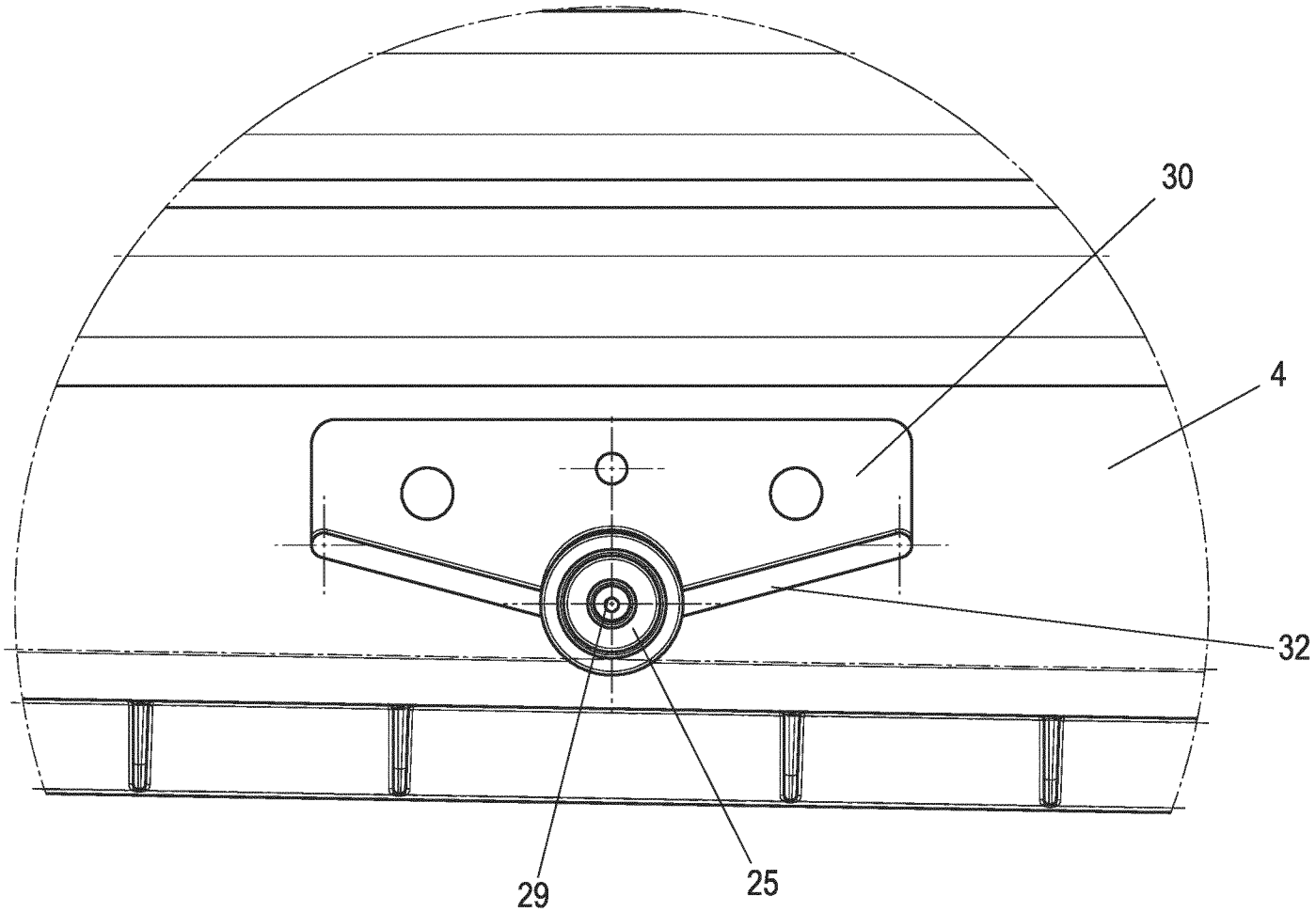
FIG. 10 shows a detail view of the driver in the coupled position.

In FIG. 10, the driver 30 and the deflection roller 25 having the axis 29 are shown in the locked position. In this position, the drawer elements 2 and 4 are moved together at different speeds.

Figure 11:
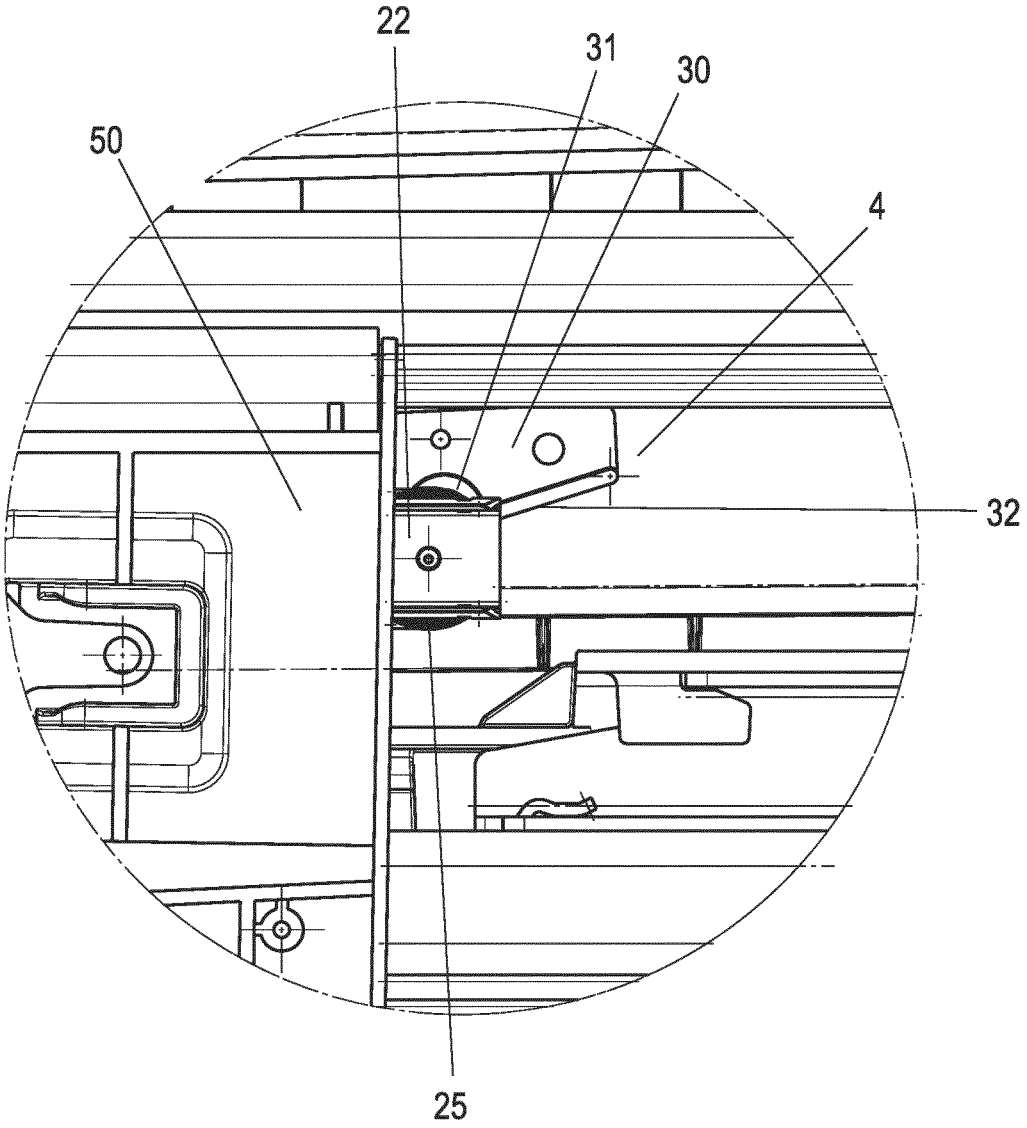
FIG. 11 shows a detail view of the driver in the coupled-in position.
Figure 14:
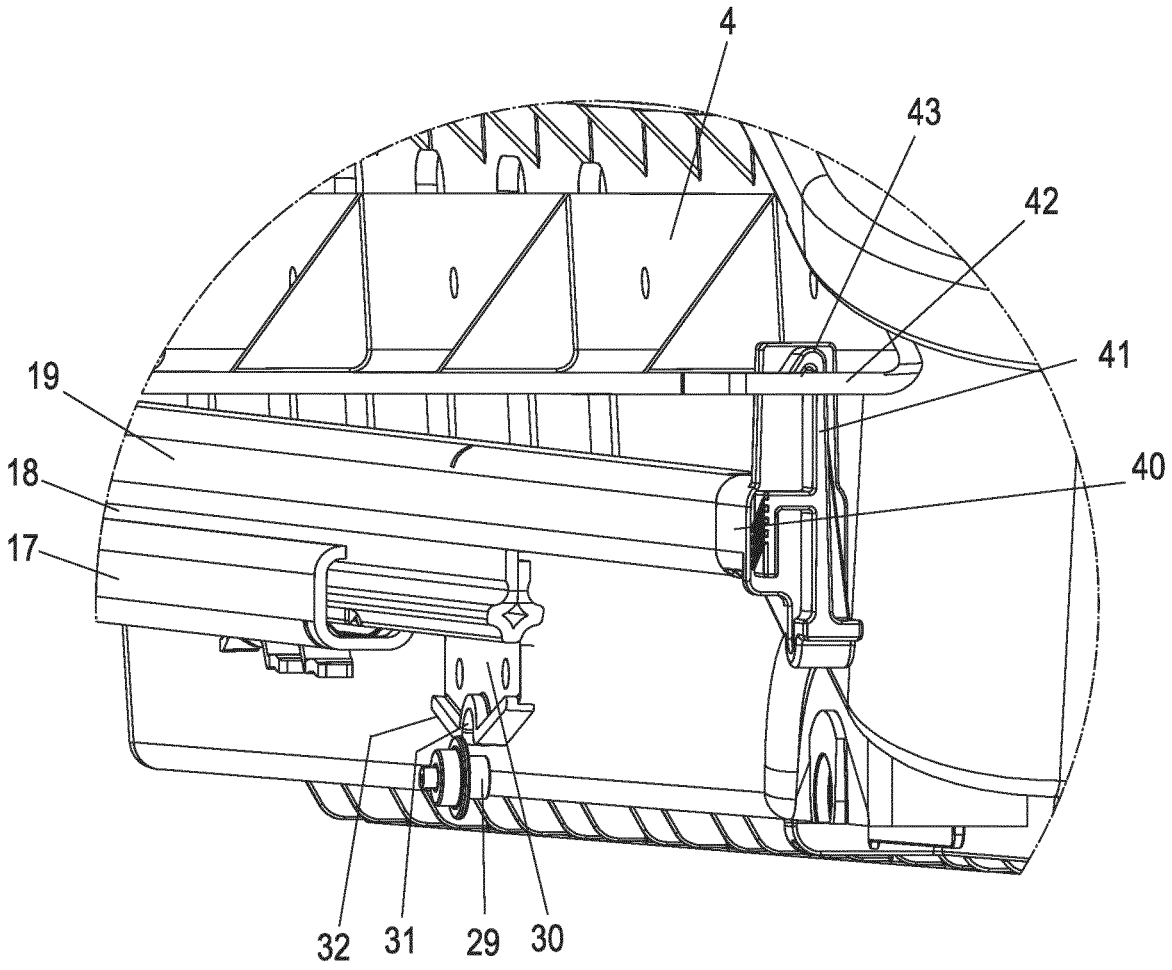
FIG. 14 shows a detail view of the second drawer element in the raised position.

In FIG. 11, the driver 30 is shown in the maximally pulled-out position of the movable rail 22, which only protrudes from the body 50 in the region of the deflection roller 25. In this position, the second drawer element 4 can be slightly raised in order to disengage the catch unit, as shown in FIG. 14. Optionally, unlocking of the catch unit can also be effectuated only by pulling or pushing the second drawer element 4.

Figure 12:
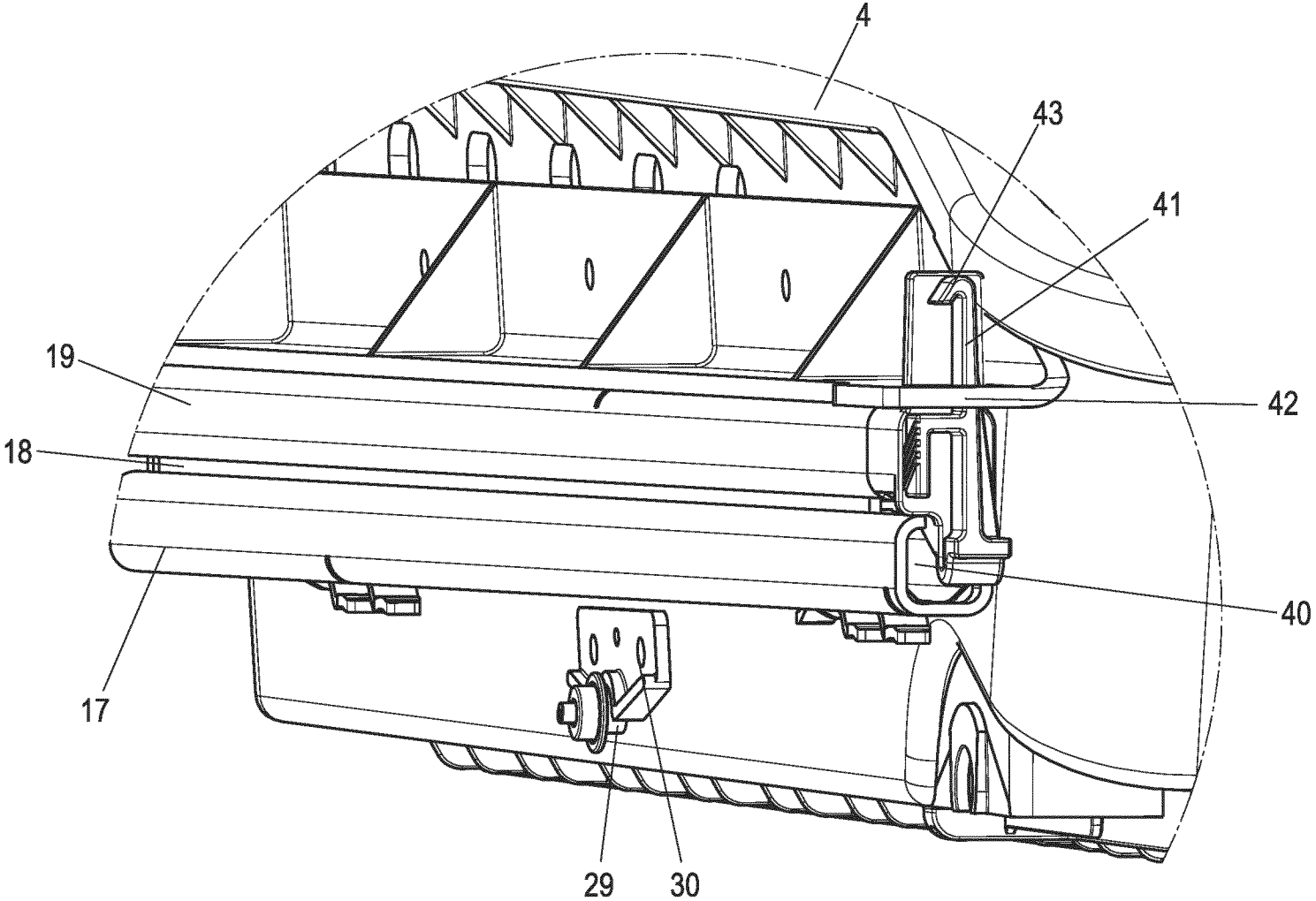
FIG. 12 shows a view of the second drawer element in the lowered position.
Figure 13:
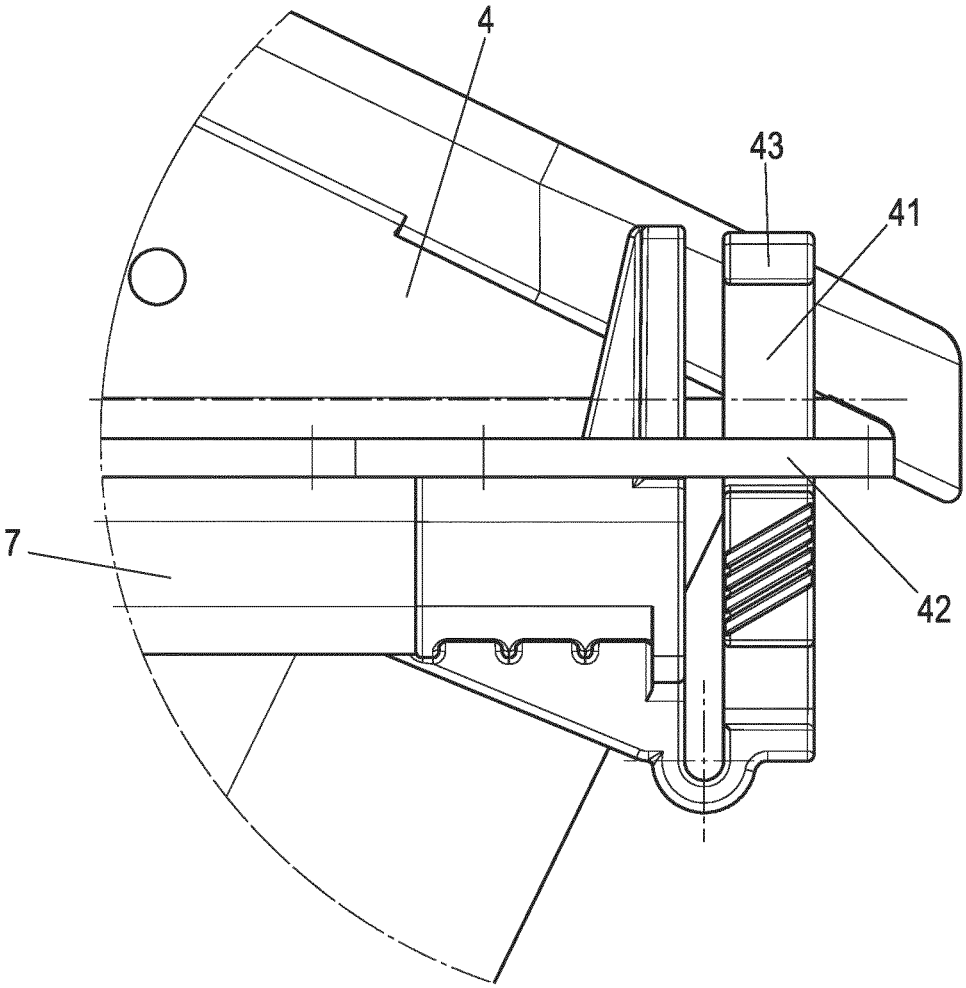
FIG. 13 shows a detail view of the lift limiting unit for the second drawer element.

In FIG. 12 and FIG. 13, the second drawer element 4 is shown in a lowered position, in which an edge 42 rests on the slide rail 19. A plug 40 is inserted into the end of the slide rail 19, at which plug a lift limiting unit is provided for limiting the lift movement of the second drawer element 4. The lift limiting unit comprises an upwardly protruding web 41, on the end of which a hook 43 is formed. The web 41 encloses an edge 42 of the drawer element 4 in this case. The lift limiting unit having the web 41 and the hook 43 is shown in detail in FIG. 13.

Figure 15:
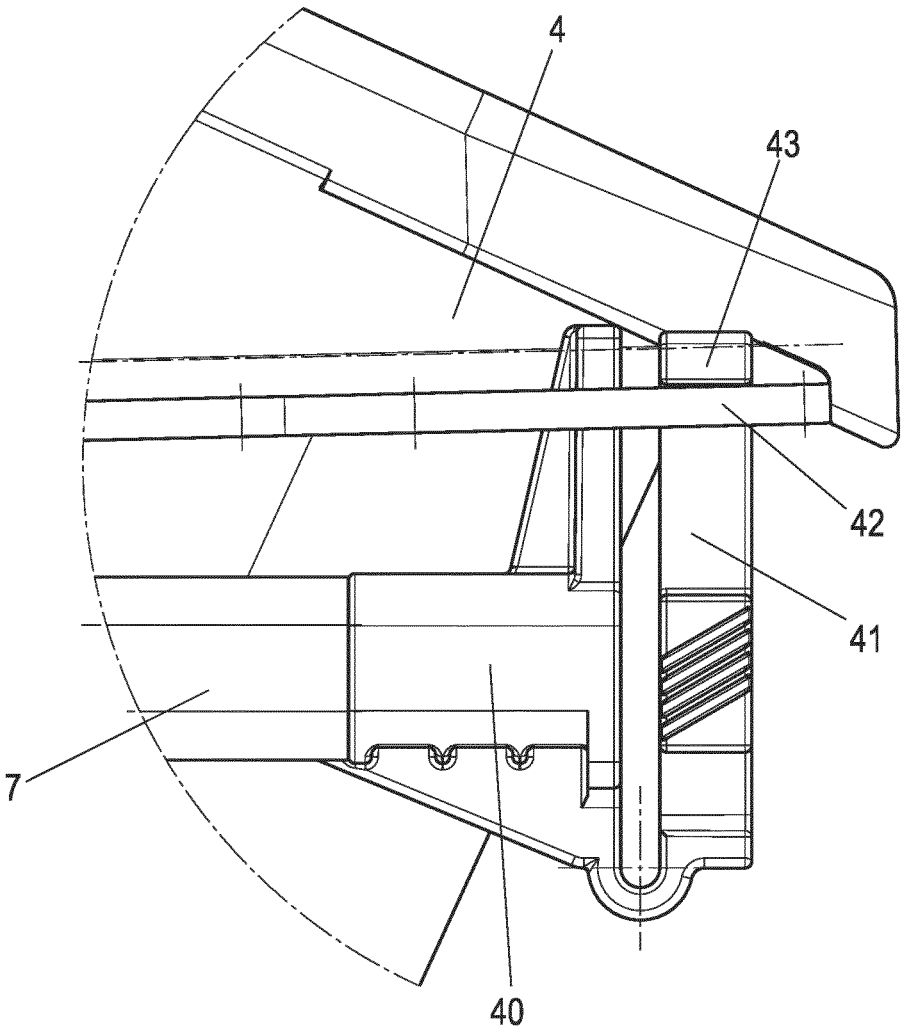
FIG. 15 shows a detail view of the lift limiting unit in the stop position.

If the second drawer element 4 is slightly raised, the position shown in FIGS. 14 and 15 is reached. The edge 42 has been moved upward along the web 41, until the hook 43 prevents further raising of the edge 42 and the drawer element 4. In this position, the driver 30 connected to the drawer element 4 has also been raised and is no longer engaged with the axis 29. The slide rail 19 can thus be moved independently of the coupling mechanism 20.

To engage the coupling mechanism 20 again, the first drawer element 2 and the second drawer element 4 can be moved back into the closed position, as shown in FIGS. 1, 4, and 5. By moving the first drawer element in relation to the second drawer element 4, the axis 29 reaches the starting bevel 32 and is locked in the catch receptacle 31 upon reaching the closed position, so that then upon reopening of the first drawer element 2, the coupling mechanism 20 is engaged again.

In the illustrated exemplary embodiment, the coupling mechanism 20 is connected to the slide rail 7 of the first pullout guide 6. Of course, it is also possible to secure the coupling mechanism directly on the middle rail 8 of the first pullout guide 6, since it is already moved at half the speed of the slide rail 7. A holder coupled to the middle rail 8 could be engaged directly with the driver 30. However, the use of an additional movable rail 22 has the advantage of enhanced stability, in particular in the case of drawer elements 2 and 4 having greater height.

The coupling mechanism 20 comprises a catch unit having a catch receptacle open toward the bottom on the upper drawer element 4, which can be engaged with an axis or a pin. Of course, it is also possible to provide the coupling mechanism 20 with other catch units, which enable a certain force transmission in the opening and closing directions between the first drawer element 2 and the second drawer element 4 and are unlockable by an actuation or exceeding a force. It is also possible to use a spring-loaded driver 30, which pivots or moves linearly for decoupling in the event of external force application in the opening or closing direction on the upper drawer element 4 and thus detaches the coupling mechanism 20 and subsequently thereto moves back into its starting position again.

For unlocking, the second drawer element 4 is slightly raised in the illustrated exemplary embodiment. Of course, it is also possible to provide an actuating element, for example, a lever or a button, by means of which the catch unit is disconnectable.

LIST OF REFERENCE SIGNS

1 device
2 drawer element
3 front panel
4 drawer element
5 holder
6 pullout guide
7 slide rail
8 middle rail
9 guide rail
10 mounting bracket
11 cable pull
12 holder
13 holder
14 deflection roller
15 deflection roller
16 pullout guide
17 guide rail
18 middle rail
19 slide rail
20 coupling mechanism
21 holding part
22 rail
23 23 rail
24 cable pull
25 deflection roller
26 fastening element
29 axis
30 driver
31 catch receptacle
32 starting bevel
40 plug
41 web
42 edge
43 hook
50 body

What is claimed is:

1. A device for storing objects, comprising:

a first drawer element (2), which is movably mounted via at least one first pullout guide (6) between a closed position and a maximally open position, wherein said at least one first pullout guide comprises a stationary guide rail (9) and a slide rail (7) movable in relation to the guide rail (9), on which the first drawer element (2) is supported;

a second drawer element (4), which is movably mounted via at least one second pullout guide (16) between a closed position and a maximally open position, wherein said at least one second pullout guide comprises a stationary guide rail (17) and a slide rail (19) movable in relation to the guide rail (17), on which the second drawer element (4) is supported;

wherein the slide rail (7) of the first pullout guide (6) is movable independently of the slide rail (19) of the second pullout guide (16), and further comprising a coupling mechanism (20) configured to enable the second drawer element (4) to move into a moderately open position between the closed position and the maximally open position in the event of a movement of the first drawer element (2) from the closed position into the maximally open position, wherein the coupling mechanism (20) is configured to enable the second drawer element (4) to move independently of the first drawer element (2) into the maximally open position or the closed position, wherein a driver (30), which is configured to be detachably engaged with a coupling element or catch element (29), is provided on the second drawer element (4) and wherein the driver (30) comprises a catch receptacle (31) and a starting bevel (32) for coupling in the coupling element or catch element (29) is provided on opposing sides of the catch receptacle (31).

2. The device according to claim 1, wherein the coupling mechanism (20) comprises a catch unit having a catch receptacle (31) and a catch element (29) engaging in the catch receptacle (31), which are disconnectable to detach the coupling mechanism (20).

3. The device according to claim 1, wherein the first pullout guide (6) comprises a middle rail (8), which is arranged between the slide rail (7) and the guide rail (9), and the second drawer element (4) is movable via the coupling mechanism (20) at the same speed as the middle rail (8).

4. The device according to claim 1, wherein the second drawer element (4) is configured to be raised in relation to the second pullout guide (16).

5. The device according to claim 4, wherein a stop (43) is provided, which delimits movement of the second drawer element (4) upward.

6. The device according to claim 1, wherein the second drawer element (4) is formed as an inner drawer, which is arranged behind a front panel (3) of the first drawer element (2).

7. A domestic appliance having the device for storing objects according claim 1.

8. An item of furniture having the device for storing objects according to claim 1.

9. A device for storing objects, comprising:

a first drawer element (2), which is movably mounted via at least one first pullout guide (6) between a closed position and a maximally open position, wherein said at least one first pullout guide comprises a stationary guide rail (9) and a slide rail (7) movable in relation to the guide rail (9), on which the first drawer element (2) is supported;

a second drawer element (4), which is movably mounted via at least one second pullout guide (16) between a closed position and a maximally open position, wherein said at least one second pullout guide comprises a stationary guide rail (17) and a slide rail (19) movable in relation to the guide rail (17), on which the second drawer element (4) is supported and wherein the slide rail (7) of the first pullout guide (6) is movable independently of the slide rail (19) of the second pullout guide (16), and a coupling mechanism (20) configured to enable the second drawer element (4) to move into a moderately open position between the closed position and the maximally open position in the event of a movement of the first drawer element (2) from the closed position into the maximally open position, wherein the coupling mechanism (20) is configured to enable the second drawer element (4) to move independently of the first drawer element (2) into the maximally open position or the closed position, and wherein the coupling mechanism (20) comprises a movable rail (22), which is connected via a cable pull (24) to a holding part (21) on the slide rail (7) of the first pullout guide (6).

10. The device according to claim 9, wherein a driver (30), which is configured to be detachably engaged with a coupling element or catch element (29), is provided on the second drawer element (4).

11. The device according to claim 10, wherein the driver (30) comprises a catch receptacle (31) and a starting bevel (32) for coupling in the coupling element or catch element (29) is provided on opposing sides of the catch receptacle (31).

12. A device for storing objects, comprising:

a first drawer element (2), which is movably mounted via at least one first pullout guide (6) between a closed position and a maximally open position, wherein said at least one first pullout guide comprises a stationary guide rail (9) and a slide rail (7) movable in relation to the guide rail (9), on which the first drawer element (2) is supported;

a second drawer element (4), which is movably mounted via at least one second pullout guide (16) between a closed position and a maximally open position, wherein said at least one second pullout guide comprises a stationary guide rail (17) and a slide rail (19) movable in relation to the guide rail (17), on which the second drawer element (4) is supported and wherein the slide rail (7) of the first pullout guide (6) is movable independently of the slide rail (19) of the second pullout guide (16), and a coupling mechanism (20) configured to enable he second drawer element (4) to move into a moderately open position between the closed position and the maximally open position in the event of a movement of the first drawer element (2) from the closed position into the maximally open position, wherein the coupling mechanism (20) is configured to enable the second drawer element (4) to move independently of the first drawer element (2) into the maximally open position or the closed position, and wherein the coupling mechanism (20) comprises at least one deflection roller (25) for a cable pull (24).

13. The device according to claim 12, wherein an axis (29) is extended beyond the deflection roller (25) and is insertable into a catch receptacle (31) of a driver (30) on the second drawer element (4).

14. A method for opening and closing a device for storing objects, having the following steps:

moving a first drawer element (2), which is movably mounted on at least one first pullout guide (6), from a closed position into a maximally open position;

moving a second drawer element (4), which is movably mounted on at least one second pullout guide (16), by way of a coupling mechanism (20) between the first drawer element (2) and the second drawer element (4) into a moderately open position wherein the second drawer element (4) is moved by the coupling mechanism (20) at half the speed of the first drawer element (2) during a movement of the first drawer element (2), decoupling the coupling mechanism (20) and moving the second drawer element (4) independently of the first drawer element (2) in an opening or closing direction, and coupling in the coupling mechanism (20) by moving the first drawer element (2) into the closed position when the second drawer element (4) is already in the closed position.

* * * * *